US012685351B2

(12) United States Patent
Xu et al.

(10) Patent No.: US 12,685,351 B2
(45) Date of Patent: Jul. 21, 2026

(54) PATTERNED MULTI-LAYER FABRIC AND SHAPEWEAR

(71) Applicant: Shapellx US Inc., Rancho Cucamonga, CA (US)

(72) Inventors: Zhennan Xu, Xiamen City (CN); Jun Zeng, Xiamen City (CN); Huijuan Lin, Xiamen City (CN)

(73) Assignee: Shapellx US Inc., Ranch Cucamonga, CA (US)

( * ) Notice: Subject to any disclaimer, the term of this patent is extended or adjusted under 35 U.S.C. 154(b) by 6 days.

(21) Appl. No.: 18/648,542

(22) Filed: Apr. 29, 2024

(65) Prior Publication Data

US 2025/0221475 A1 Jul. 10, 2025

(30) Foreign Application Priority Data

Feb. 3, 2024 (CN) ..... 202420262816.0

(51) Int. Cl.
*A41D 13/02* (2006.01)
*A41D 27/02* (2006.01)

(52) U.S. Cl.
CPC ..... *A41D 13/02* (2013.01); *A41D 27/02* (2013.01); *A41D 2400/38* (2013.01)

(58) Field of Classification Search
CPC ..... A41B 11/14; A41B 9/08; A41D 2400/38; A41D 27/02
See application file for complete search history.

(56) References Cited

U.S. PATENT DOCUMENTS

| | | | | |
|---|---|---|---|---|
| 6,174,217 | B1 * | 1/2001 | Judson | A41C 3/0042 450/7 |
| 6,279,161 | B1 * | 8/2001 | Johnston | A41D 13/0015 2/69 |
| 12,302,954 | B2 * | 5/2025 | Xu | A41D 1/22 |
| 2024/0389683 | A1 * | 11/2024 | Xu | A41B 9/08 |
| 2025/0098797 | A1 * | 3/2025 | Xu | A41B 9/007 |

* cited by examiner

*Primary Examiner* — Katherine M Moran
(74) *Attorney, Agent, or Firm* — Kaufman & Canoles, P.C.

(57) ABSTRACT

The present disclosure relates to the technical field of body-shaping garments, and specifically to a multi-layer fabric with patterns and a body-shaping garment. The multi-layer fabric includes a top fabric layer, a lining fabric layer, and an intermediate fabric layer between the top fabric layer and the lining fabric layer. The intermediate fabric layer includes a hollow pattern. The portion of the top fabric layer that corresponds to the hollow pattern is a see-through mesh structure, and the portion of the lining fabric layer that corresponds to the hollow pattern is a certain color so that the certain color is viewable through the see-through mesh structure of the top fabric layer.

19 Claims, 6 Drawing Sheets

PATTERNED MULTI-LAYER FABRIC AND SHAPEWEAR

TECHNICAL FIELD

The present disclosure relates to the technical field of body-shaping garments, and specifically to a multi-layer fabric with patterns and a body-shaping garment.

BACKGROUND

Body-shaping clothing is a type of close-fitting clothing that uses body-shaping elastic fabrics partially or entirely to pressure-shape the body, including specific body areas of the wearer. It has various styles, such as bodysuits, jumpsuits, girdles, bone garments, and the like. In the current technology, to enhance the shaping effect of certain body areas, some techniques will sew or fit a layer of inner fabric to the inside of the surface fabric and use double layers of elastic fabric inside and outside to enhance the compression effect. However, this double layer shaping fabric is just a dying process to obtain a uniform color tone, without providing patterns. In order to improve the decorative beauty of the fabric, some techniques will add an additional decorative layer to the surface fabric through ink printing, sewing, embroidery or lamination. While other techniques will change the surface fabric to a special jacquard fabric with a patterned structure, with no use of contrasting color splicing of multiple layers of fabrics.

SUMMARY

The purpose of this disclosure is to provide a multi-layered fabric and body-shaping garment with patterns, which can have a decorative, aesthetic appearance.

In order to achieve the above purpose, this disclosure provides the following exemplary embodiments:

A multi-layered fabric with patterns, including a top fabric layer, a lining fabric layer, and an intermediate fabric layer between the top fabric layer and the lining fabric layer. The intermediate fabric layer is provided with a hollow pattern, and the portion of the top fabric layer corresponding to the hollow pattern is composed of see-through mesh. The portion of the lining corresponding to the hollow pattern is set as the background color portion. Further, the color of the background color portion is different from the color of the intermediate fabric layer, and when worn, the naked eye can see the background color through the mesh portion having a grid pattern with the background color as the base color and a hollow pattern as the outline.

According to another aspect, the top fabric layer, the intermediate fabric layer and the lining fabric layer are stitched and/or seamlessly joined together.

According to another aspect, the hollow pattern is a continuous pattern or an intermittent pattern.

According to another aspect, the intermediate fabric layer is composed of a plurality of fabric pieces, and the spacing area between adjacent fabric pieces constitutes the hollow pattern.

According to another aspect, the intermediate fabric layer, the top fabric layer and the lining fabric layer are composed of elastic fabrics, which not only enhances the visual aesthetic appearance, but also enhances the stretch and resilience performance to enhance the shaping effect.

According to one aspect, a body-shaping garment includes a front piece set composed of the above-mentioned multi-layer fabric with patterns, and a top fabric layer, an intermediate fabric layer and a lining fabric layer are composed of elastic fabrics.

According to another aspect, the body-shaping garment is a bodysuit or jumpsuit.

According to another aspect, the front of the upper body of the shaping garment is provided with a longitudinal opening and first opening and closing members positioned on both sides of the longitudinal opening, and the upper end of the longitudinal opening extends to the upper end of the shaping garment.

According to another aspect, the hollow pattern is symmetrically arranged on the front panel of the body shaping garment.

According to another aspect, the multi-layer fabric corresponding to the abdominal area of the human body and positioned between the two hollow patterns also includes a non-elastic clip layer. The non-elastic clip layer is positioned between the middle layer and the lining and is staggered from the hollow patterns.

Compared with existing technology, this disclosure includes the following beneficial effects:

The multi-layer fabric of this disclosure includes a lining fabric layer, a top fabric layer and an intermediate fabric layer. The intermediate fabric layer is provided with a hollow pattern. The area of the top fabric layer corresponding to the hollow pattern is set as the mesh portion, and the area of the lining fabric layer corresponding to the hollow pattern is set as the base color portion. The intermediate layer and the top fabric layer can work together to cover the lining fabric layer outside the hollow area. The size of the apertures of the mesh is such that the naked eye can directly observe the lining fabric layer corresponding to the hollow pattern through perspective, so that when wearing, the naked eye can directly observe the lining fabric layer through the mesh. A skin color is the base color and the hollow pattern is the outline of the grid pattern, thereby creating a contrasting visual beauty in the overall appearance of the fabric. Different from the existing technology, the pattern formed by printing on the surface of the fabric is more three-dimensional and more beautiful. Further, the pattern can be customized and personalized according to the wearer's needs by changing the hollow pattern of the intermediate fabric layer. The style can be a continuous pattern or a discontinuous pattern. At the same time, when each layer is composed of elastic fabric and used in body-shaping clothes, it can also be traditional at the same time. Decorative techniques do not have the function of enhancing the shaping effect; when S-shaped curve-shaped or V-shaped curve-shaped hollow patterns are set on the left and right sides of the front of the body-shaping garment, the waist-slimming effect of visually creating an S-shaped waist can be achieved.

Figure 1:
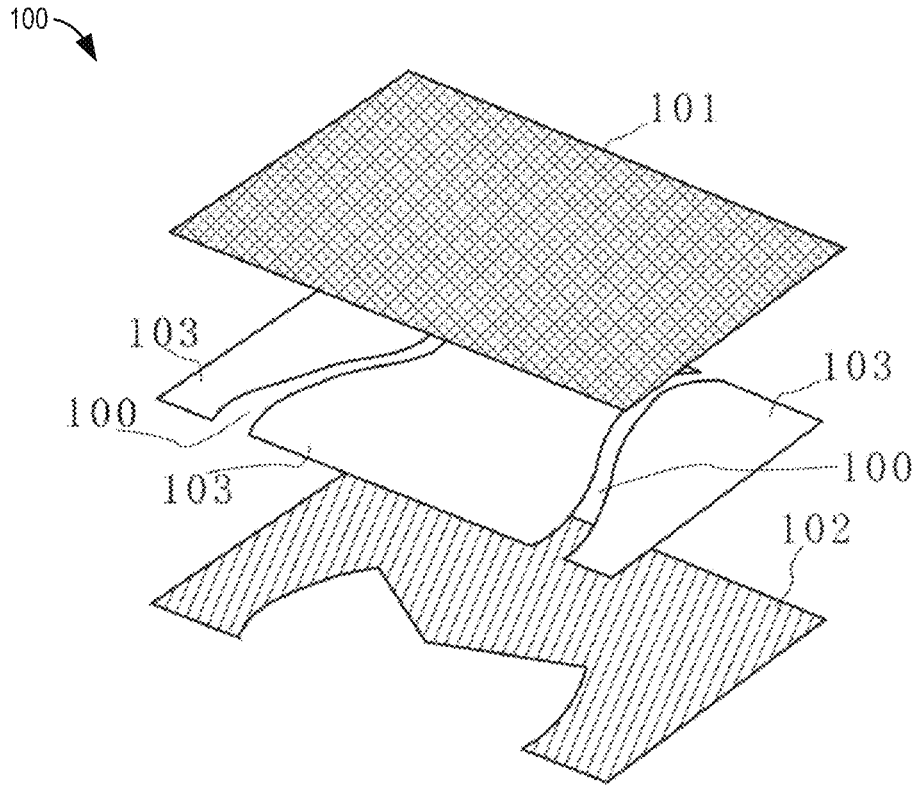
FIG. 1 is an exploded view of one embodiment of the multi-layer fabric of the present disclosure.

Marked in the figures: reference 10 corresponds to a front piece; reference 11 corresponds to a first opening and closing piece; reference 12 corresponds to a second opening and closing piece; reference 20 corresponds to a back piece set; reference 30 corresponds to a back pant panel; reference 40 corresponds to a buttock piece; reference 50 corresponds to a bra; reference 60 corresponds to shoulder straps; reference 70 corresponds to back crotch piece; reference 100 corresponds to a hollow pattern; reference 101 corresponds to a top fabric layer; reference 102 corresponds to a lining fabric layer; reference 103 corresponds to an intermediate fabric layer; reference 104 corresponds to a non-elastic clip layer.

DETAILED DESCRIPTION

In order to make the above-mentioned features and advantages of the present disclosure easier to understand, embodiments are given below and described in detail with reference to the accompanying drawings.

Exemplary Embodiment 1

Figure 2:
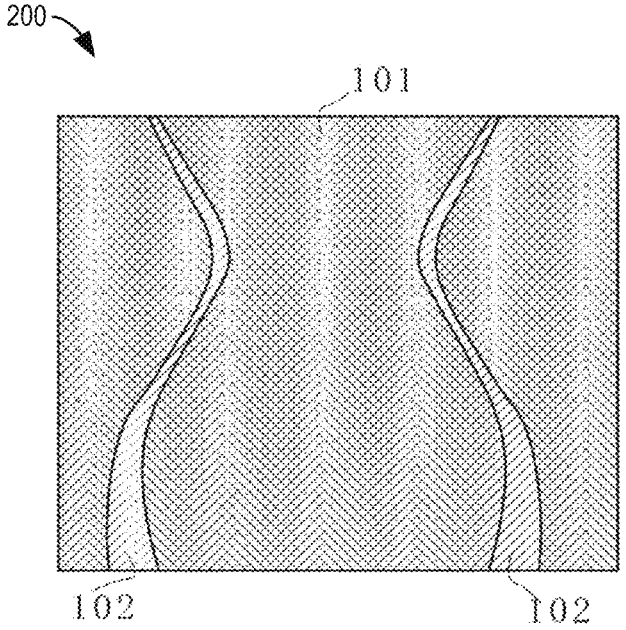
FIG. 2 is a front view of the multi-layer fabric of FIG. 1.

As shown in FIGS. 1-2, this embodiment provides a multi-layer fabric 100, 200 with patterns, including a top fabric layer 101, a lining fabric layer 102, and an intermediate fabric layer 103 positioned between the top fabric layer 101 and the lining fabric layer 102. The fabric layer 101 can have a see-through mesh structure with apertures, and the top fabric layer 101, the intermediate fabric layer 103 and the lining fabric layer 102 can be elastic fabrics.

The intermediate fabric layer 103 includes a hollow pattern 100. There are many styles of the hollow pattern 100, such as continuous patterns or discontinuous patterns. There are also many ways to form the hollow pattern 100. For example, the intermediate fabric layer 103 can include a piece of integral fabric. And a number of intermittent hollow holes can be opened on the intermediate fabric layer 103 to form a hollow pattern 100 of a preset pattern (of course, this method requires that the diameter of the hollow holes is sufficient to see through to the lining fabric layer 102 with the naked eye). Further, the intermediate fabric layer 103 can be composed of multiple pieces of fabric. A continuously extending spacing area can be left between adjacent fabric pieces to respectively form the hollow patterns 100 of the preset pattern.

Specifically, in this embodiment, the intermediate fabric layer 103 is composed of three fabric pieces, and the spacing areas left between two adjacent fabric pieces respectively can form an S-shaped curved hollow pattern 100. The S-shaped curve can have widths that are different at various positions along the S-shaped curve. The edge of the fabric piece where the hollow pattern 100 is positioned can be sewn together with the lining fabric layer 102 by elastic threads, and the edge of the fabric piece can be connected with the edge of the lining fabric layer 102 and the edge of the top fabric layer 101 by stitching so that the three fabric pieces can be distributed flatly on the outer surface of the lining fabric layer 102, and the middle portion of the top fabric layer 101 and the intermediate fabric layer 103 are suspended and separated (note that in other examples, the middle part of the top fabric layer 101 and the intermediate fabric layer 103 are can also be combined together).

In this embodiment, the three fabric pieces of the top fabric layer 101 and the intermediate fabric layer 103 can be all black, the lining fabric layer 102 can be skin color, and the portion of the top fabric layer 101 corresponding to the hollow pattern 100 can be configured as a see-through mesh portion. The part of the lining fabric layer 102 corresponding to the hollow pattern 100 can be set as the background color portion. The fabric pieces and the top fabric layer 101 can cooperate to cover the visual color of the lining fabric layer 102. When wearing, the naked eye can see through the mesh to view a grid pattern with the skin color as the base color and the S-shaped curved hollow pattern 100 as the outline. The aperture size of the mesh portion can be such that the naked eye can directly observe the lining fabric layer 102 corresponding to the hollow pattern 100.

In another embodiment, the connection method between the fabric piece and the lining fabric layer 102 can also be glue-point bonded or hot-melt adhesive film bonded to replace the edge line of the fabric piece where the hollow pattern 100 is positioned. The lining fabric layer 102 can be sewn with elastic threads. In yet another embodiment, the shape of the hollow pattern 100 can also be a V-shaped curve or other geometric shapes instead of an S-shaped curve.

Exemplary Embodiment 2

Figure 4:
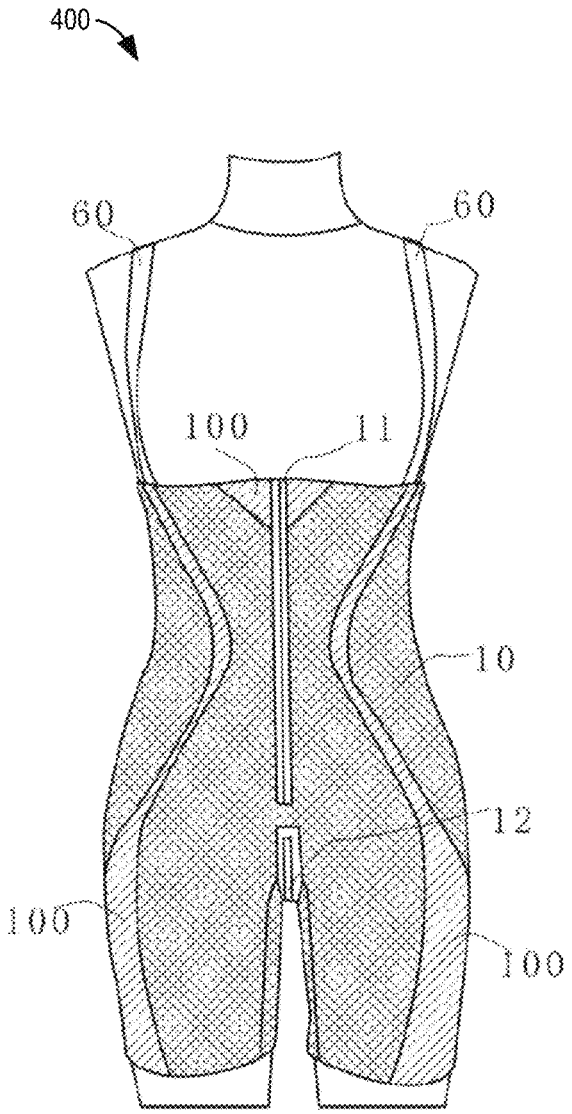
FIG. 4 is a back view of one embodiment of the jumpsuit according to Embodiment 2 of the present disclosure.
Figure 5:
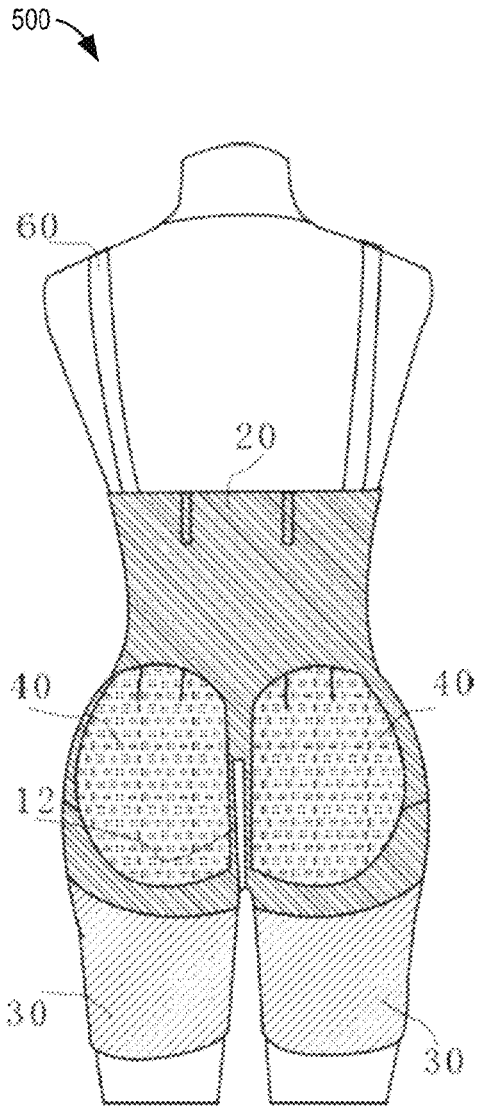
FIG. 5 is a back view of the jumpsuit of FIG. 4.

As shown in FIGS. 4 to 5, this embodiment provides a body shaping garment 400, 500 in the form of a jumpsuit, including a front panel set 10, a back piece set 20, a hip-covering panel 40, a back pant panel 30 and two shoulder straps 60, the front panel set 10 goes up to the chest and down to the thighs, the front panel set 10 is sewn together with the back piece set 20 and the back pant panel 30 at the side seams, and the front panel set 10 and the rear panel set 10 are sewn together. The back pant panel 30 can be sewn together in the inseam, and the front and rear ends of the two shoulder straps 60 can be respectively installed on the upper end of the front piece group 10 and the upper end of the back piece set 20 through 6-shaped buckles. The back piece set 20 and the back pant panel 30 can be both composed of double-layer fabric, while the hip-covering panel 40 is a single-layer fabric. The back piece set 20 can include hip holes corresponding to the positions of both buttocks, and the hip-covering panel 40 can be machined along the edge of the hip hole. The back panel set 20 can be connected with threads, and the left and right extensions of the hip-covering panel 40 can be connected to the side seams, and the lower edge of the hip-covering panel 40 can extend to under the buttocks and is stitched and connected to the inside of the back pant panel 30, thereby forming three layers of fabric under the buttocks to enhance the buttock shaping effect.

In order to reduce the pressure and discomfort caused by the hip-covering panel 40 on the buttocks, the hip-covering panel 40 in this embodiment adopts a three-dimensional cutting structure. The three-dimensional cutting structure is a well-known technology in the art and will not be described again here.

In order to facilitate using the toilet, the crotch bottom of the shapewear can include a crotch opening, and a second opening and closing member 12 can be detachably provided at the crotch opening. The second opening and closing member 12 can be a zipper, and the rear end of the zipper can extend to the buttocks. The zipper can be pulled back to the middle height of the buttocks when using the toilet, enlarging the crotch opening and improving convenience. In addition, antibacterial cotton can be sewn on the inside of both sides of the crotch opening, so that a wearer of this garment can optionally wear underwear.

In this embodiment, the front panel set 10 can be composed of multi-layer fabrics with patterns, including a top fabric layer 101, a lining fabric layer 102, and three fabric pieces positioned between the top fabric layer 101 and the lining fabric layer 102. The above-mentioned top fabric layer 101, three fabric pieces and the lining fabric layer 102 can be composed of elastic fabrics, and the top fabric layer 101 can have a see-through mesh structure with apertures, and the fabric pieces can be breathable.

The spacing area between two adjacent fabric pieces respectively can constitute an S-shaped curved hollow pattern 100. The width of the S-shaped curve can be different at different positions along the S-shaped curve. Specifically: the middle fabric piece can be distributed on the abdomen and both sides. On the inner thigh, the other two fabric pieces can be distributed on the left and right sides of the middle fabric piece. The middle fabric piece can form an S-shaped curved hollow pattern 100 with the left and right fabric pieces respectively, and the lining fabric layer 102 being distributed on the left and right sides. The inner sides of the two fabric pieces and the middle fabric piece can correspond to the inner side of the abdominal area. The top fabric layer 101 can cover the three fabric pieces, and the edge of the fabric piece where the hollow pattern 100 is positioned can be sewn together with the lining fabric layer 102 by elastic threads. Further, glue can be applied to assist in forming a connection. The edge of the fabric piece, the edge of the lining fabric layer 102 and the edge of the top fabric layer 101 can be connected to the side seams by stitching, so that the three fabric pieces are distributed flatly on the outer surface of the lining fabric layer 102 and in the middle of the top fabric layer 101. The parts can be suspended and separated from the intermediate fabric layer 103.

In this embodiment, the three fabric pieces of the top fabric layer 101 and the intermediate fabric layer 103 can be a black color, the lining fabric layer 102 can be a skin color, and the portion of the top fabric layer 101 corresponding to the hollow pattern 100 can be a see-through mesh structure. The portion of the lining fabric layer 102 corresponding to the hollow pattern 100 can be a certain background color. The fabric pieces and the top fabric layer 101 can cooperate to cover the visual color of the lining fabric layer 102. The size of each aperture of the mesh structure can be configured to be directly observed by the naked eye. In the lining fabric layer 102 corresponding to the hollow pattern 100, when wearing, the naked eye can directly observe through the mesh structure a grid with the skin color of the base color portion as the background color and the S-shaped curved hollow pattern 100 as the outline pattern. In this embodiment, two S-shaped curved hollow patterns 100 can be formed by three fabric pieces and symmetrically distributed on the front panel set 10 to visually create an S-shaped waist. In addition, a triangular hollow pattern 100 is formed in the middle of the upper end of the front panel 10.

In order to facilitate putting on and taking off, the front panel set 10 of this embodiment is provided with a longitudinal opening and first opening and closing parts 11 positioned on both sides of the longitudinal opening. The upper end of the longitudinal opening extends to the upper end of the shaping garment. The first opening and closing parts 11 are a combination of zippers and buttons. The buttons are positioned on the inside and the zipper is on the outside. The zipper and buttons are used to open and close the longitudinal opening. In order to reduce the occurrence of curling at the upper ends of the front panel set 10 and the back piece set 20 when worn, a number of rubber ribs are provided at intervals at the upper ends of the back piece set 20.

Figure 3:
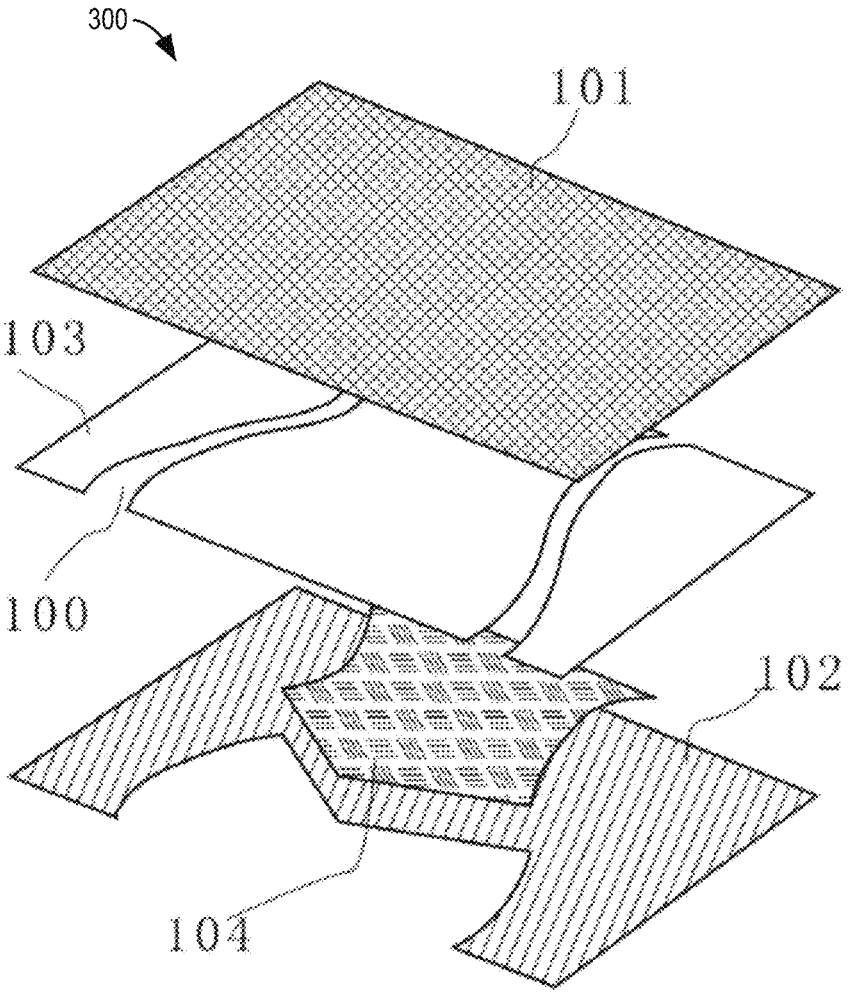
FIG. 3 is an exploded view of another embodiment of the multi-layer fabric with an elastic clip layer of the present disclosure.

In order to enhance the shaping effect of the abdomen of a wearer of the body shaping garment 400, 500, this embodiment also includes a multi-layer fabric 300 having a non-elastic clip layer 104 as illustrated in FIG. 3, in which the multi-layer fabric 300 corresponds to the abdominal area of the human body and is positioned between the two hollow patterns 100. The non-elastic clip layer 104 is positioned between the intermediate fabric layer 103 and the lining fabric layer 102. Between them and staggered from the hollow pattern 100, the non-elastic clip layer 104 is composed of transversely inelastic fabric.

Exemplary Embodiment 3

Figure 6:
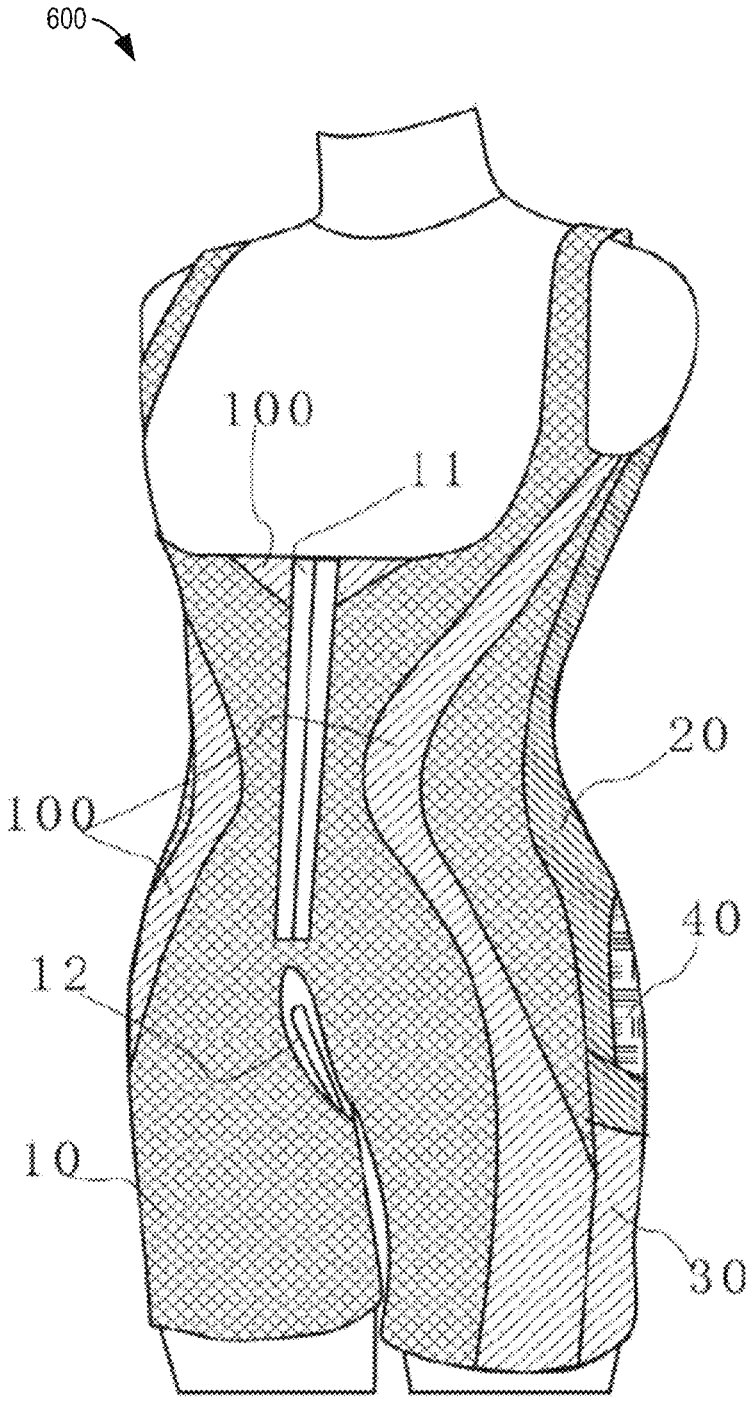
FIG. 6 is a perspective view of another embodiment of the jumpsuit according to Embodiment 3 of the present disclosure.

As shown in FIG. 6, this embodiment provides a body-shaping garment 600 in the form of a jumpsuit, including a front panel set 10, a back piece set 20, a hip-covering panel 40, and a back pant panel 30. The panel set 10 can extend up to the chest and down to the thighs, and the upper end of the front panel set 10 also can have extension panels on the left and right sides, respectively. The front panel set 10 can be connected to the back piece set 20 and the back pant panel 30 by sewing at the side seams. Together, the corresponding sides of the upper ends of the extension piece and the back piece set 20 can be connected through adjustable shoulder straps (not shown in the figure) to form armholes, and the front piece set 10 and the back pant panel 30 can be sewn together in the inseam. The back piece set 20 and the back pant panel 30 can both be composed of double-layer fabric, while the hip-covering panel 40 can be a single-layer fabric. The back piece set 20 can include hip holes corresponding to the positions of both buttocks, and the hip-covering panel 40 can be machined along the edge of the hip hole. The back panel set 20 can be connected with threads, and the left and right extensions of the hip-covering panel 40 can be connected to the side seams, and the lower edge of the hip-covering panel 40 can extend to under the buttocks and can be stitched and connected to the inside of the back pant panel 30, thereby forming three layers of fabric under the buttocks to enhance the buttock shaping effect.

In order to reduce the pressure and discomfort caused by the hip-covering panel 40 on the buttocks, the hip-covering panel 40 in this embodiment can adopt a three-dimensional cutting structure. The three-dimensional cutting structure is a well-known technology in the art and will not be described again here.

In order to facilitate using the toilet, the crotch bottom of the shapewear can include a crotch opening, and a second opening and closing member 12 can be detachably provided at the crotch opening. The second opening and closing member 12 can be a zipper, and the rear end of the zipper can extend to the buttocks. The zipper can be pulled back to the middle height of the buttocks when using the toilet, enlarging the crotch opening and improving convenience. In addition, antibacterial cotton can be sewn on the inside of both sides of the crotch opening, so that a wearer of this garment can optionally wear underwear.

In this embodiment, the front panel set 10 can be composed of multi-layer fabrics with patterns, including a top fabric layer 101, a lining fabric layer 102, and three fabric pieces positioned between the top fabric layer 101 and the lining fabric layer 102. The above-mentioned top fabric layer 101, three fabric pieces and the lining fabric layer 102 are all elastic fabrics, and the top fabric layer 101 has a see-through mesh structure with mesh, and the fabric pieces are breathable.

The spacing area left between two adjacent fabric pieces respectively constitutes an S-shaped curved hollow pattern 100. The width of the S-shaped curve is different at different positions. Specifically: the middle fabric piece is distributed on the abdomen and both sides. On the inner thigh, the other two fabric pieces are distributed on the left and right sides of the middle fabric piece. The middle fabric piece forms an S-shaped curved hollow pattern 100 with the left and right fabric pieces respectively, and the lining fabric layer 102 is distributed on the left and right sides. The inner sides of the two fabric pieces and the middle fabric piece correspond to the inner side of the abdominal area. The top fabric layer 101 covers the three fabric pieces, and the edge of the fabric piece where the hollow pattern 100 is positioned is sewn together with the lining fabric layer 102 through elastic threads. And glue is applied to assist in forming a connection, and the edges of the fabric pieces, the edges of the lining fabric layer 102 and the edges of the top fabric layer 101 are connected together through stitching, so that the three fabric pieces are flatly distributed on the outer surface of the lining fabric layer 102, and the middle part of the top fabric layer 101 It is suspended and separated from the intermediate fabric layer 103.

In this embodiment, the three fabric pieces of the top fabric layer 101 and the intermediate fabric layer 103 are all black, the lining fabric layer 102 is skin color, and the part of the top fabric layer 101 corresponding to the hollow pattern 100 is configured as a see-through mesh structure. The part of the lining fabric layer 102 corresponding to the hollow pattern 100 is set as the background color part. The fabric pieces and the top fabric layer 101 cooperate to cover the visual color of the lining fabric layer 102. The mesh size of the mesh part is sufficient to be directly observed by the naked eye. In the lining fabric layer 102 corresponding to the hollow pattern 100, when wearing, the naked eye can directly observe through the mesh portion a grid with the skin color of the base color portion as the background color and the S-shaped curved hollow pattern 100 as the outline pattern. In this embodiment, two sets of S-shaped curved hollow patterns 100 formed by three fabric pieces are symmetrically distributed on the front panel set 10 to visually create an S-shaped waist. In addition, a triangular hollow pattern 100 is formed in the middle of the upper end of the front panel 10.

In order to facilitate putting on and taking off the garment, the front panel set 10 of this embodiment can include a longitudinal opening and first opening and closing parts 11 positioned on both sides of the longitudinal opening. The upper end of the longitudinal opening can extend to the upper end of the shaping garment. The first opening and closing parts 11 can be a combination of zippers and buttons. The buttons can be positioned on the inside and the zipper can be on the outside. The zipper and buttons can be used to open and close the longitudinal opening.

In order to enhance the shaping effect of the abdomen, this embodiment also includes a non-elastic clip layer 104 in the multi-layer fabric corresponding to the abdominal area of the human body and positioned between the two hollow patterns 100. The non-elastic clip layer 104 can be positioned between the intermediate fabric layer 103 and the lining fabric layer 102. Between them and staggered from the hollow pattern 100, the non-elastic clip layer 104 can be composed of transversely inelastic fabric.

Exemplary Embodiment 4

Figure 7:
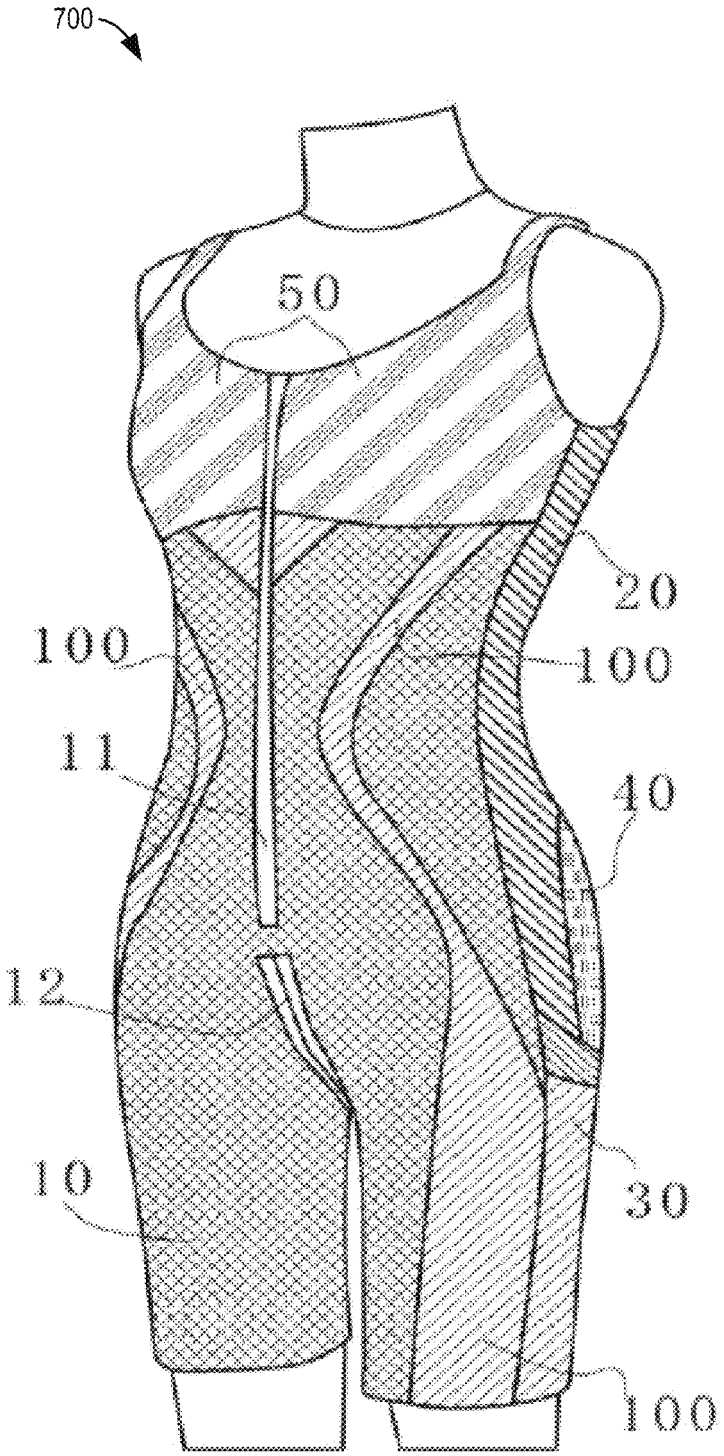
FIG. 7 is a perspective view of another embodiment of the jumpsuit according to Embodiment 4 of the present disclosure.

As shown in FIG. 7, this embodiment provides a body-shaping garment 700 in the form of a jumpsuit, including a front panel set 10, a back piece set 20, a hip-covering panel 40, a back pant panel 30 and a bra top 50, the front panel set 10 goes up to the bottom of the chest and down to the thigh, and the front panel set 10 is respectively connected to the side seam between the back panel set 20 and the back pant panel 30, and between the bra top 50 and the back panel set 20. The front panel set 10 and the back pant panel 30 can be stitched together in the inner seam. The bra top 50 can be stitched and connected to the upper end of the front panel set 10 and the upper end of the bra top 50 can pass through the back panel set 20. Adjustable shoulder straps (not shown) can be connected to form armholes. The back piece set 20 and the back pant panel 30 can both be composed of double-layer fabric, while the hip-covering panel 40 is a single-layer fabric. The back piece set 20 can include hip holes corresponding to the positions of both buttocks, and the hip-covering panel 40 can be machined along the edge of the hip hole. The back piece set 20 can be connected with threads, and the left and right extensions of the hip-covering panel 40 can be connected to the side seams, and the lower edge of the hip-covering panel 40 can extend to under the buttocks and can be stitched and connected to the inside of the back pant panel 30, thereby forming three layers of fabric under the buttocks to enhance the buttock shaping effect.

In order to reduce the pressure and discomfort caused by the hip-covering panel 40 on the buttocks, the hip-covering panel 40 in this embodiment can adopt a three-dimensional cutting structure. The three-dimensional cutting structure is a well-known technology in the art and will not be described again here.

In order to facilitate using the toilet, the crotch bottom of the shapewear can include a crotch opening, and a second opening and closing member 12 can be detachably provided at the crotch opening. The second opening and closing member 12 can be a zipper, and the rear end of the zipper can extend to the buttocks. The zipper can be pulled back to the middle height of the buttocks when using the toilet, enlarging the crotch opening and improving convenience. In addition, antibacterial cotton can be sewn on the inside of both sides of the crotch opening, so that a wearer of this garment can optionally wear underwear.

In this embodiment, the front panel set 10 can be composed of multi-layer fabrics with patterns, including a top fabric layer 101, a lining fabric layer 102, and three fabric pieces positioned between the top fabric layer 101 and the lining fabric layer 102. The above-mentioned top fabric layer 101, three fabric pieces and the lining fabric layer 102 are all elastic fabrics, and the top fabric layer 101 has a see-through mesh structure with mesh, and the fabric pieces are breathable.

The spacing area left between two adjacent fabric pieces respectively can constitute an S-shaped curved hollow pattern 100. The width of the S-shaped curve can be different at different positions along the S-shaped curve. Specifically: the middle fabric piece can be distributed on the abdomen and both sides. On the inner thigh, the other two fabric pieces can be distributed on the left and right sides of the middle fabric piece. The middle fabric piece can form an S-shaped curved hollow pattern 100 with the left and right fabric pieces respectively, and the lining fabric layer 102 can be distributed on the left and right sides. The inner sides of the two fabric pieces and the middle fabric piece can correspond to the inner side of the abdominal area. The top fabric layer 101 can cover the three fabric pieces, and the edge of the fabric piece where the hollow pattern 100 is positioned can be sewn together with the lining fabric layer 102 by elastic threads. Further, glue can be applied to assist in forming a connection, and the edges of the fabric pieces, the edges of the lining fabric layer 102 and the edges of the top fabric layer 101 can be connected together through stitching, so that the three fabric pieces are flatly distributed on the outer surface of the lining fabric layer 102, and the middle part of the top fabric layer 101 is suspended and separated from the intermediate fabric layer 103.

In this embodiment, the three fabric pieces of the top fabric layer 101 and the intermediate fabric layer 103 can be a black color, the lining fabric layer 102 can be a skin color, and the part of the top fabric layer 101 corresponding to the hollow pattern 100 can be a see-through mesh structure. The part of the lining fabric layer 102 corresponding to the hollow pattern 100 can be set as the background color part. The fabric pieces and the top fabric layer 101 can cooperate to cover the visual color of the lining fabric layer 102. The size of each aperture of the mesh structure can be sufficient to be directly observed by the naked eye. In the lining fabric layer 102 corresponding to the hollow pattern 100, when wearing, the naked eye can directly observe through the mesh structure a grid with the skin color of the base color portion as the background color and the S-shaped curved hollow pattern 100 as the outline pattern. In this embodiment, two S-shaped curved hollow patterns 100 formed by three fabric pieces can be symmetrically distributed on the front panel set 10 to visually create an S-shaped waist. In addition, a triangular hollow pattern 100 can be formed in the middle of the upper end of the front panel 10.

In order to facilitate putting on and taking off, the body shaping garment of this embodiment can include a longitudinal opening and first opening and closing parts 11 positioned on both sides of the longitudinal opening. The upper end of the longitudinal opening can extend to the upper end of the bra 50, and the first opening and closing part 11 can be a zipper. Combined with the button, the button can be positioned on the inside and the zipper can be positioned on the outside. The zipper and the button can be used to open and close the longitudinal opening.

In order to enhance the shaping effect of the abdomen, this embodiment also includes a non-elastic clip layer 104 in the multi-layer fabric corresponding to the abdominal area of the human body and positioned between the two hollow patterns 100. The non-elastic clip layer 104 can be positioned between the intermediate fabric layer 103 and the lining fabric layer 102. Between them and staggered from the hollow pattern 100, the non-elastic clip layer 104 can be composed of transversely inelastic fabric.

Exemplary Embodiment 5

Figure 8:
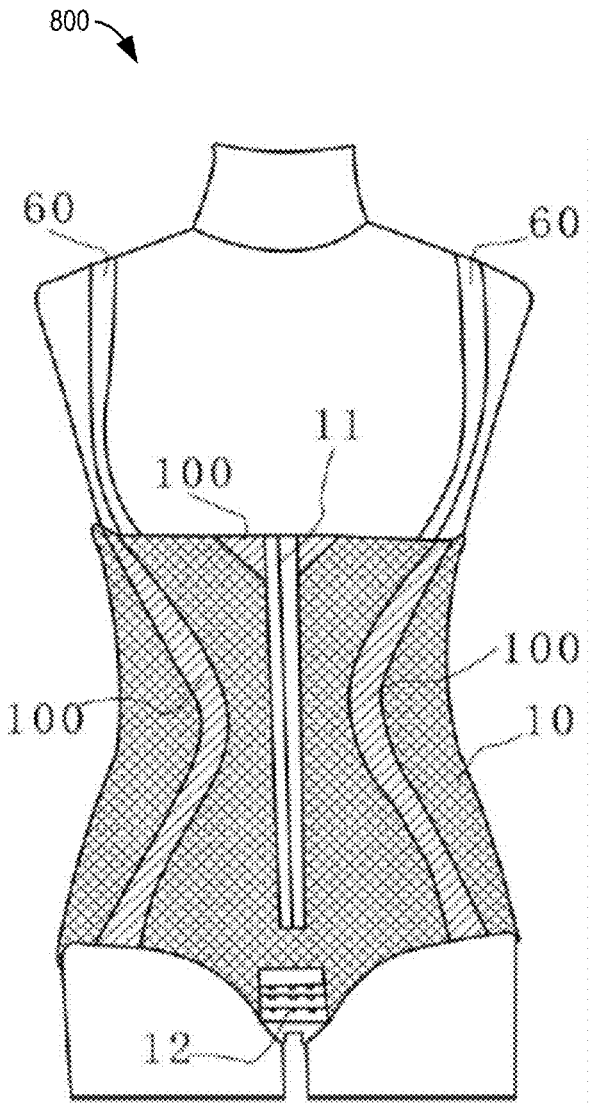
FIG. 8 is a front view of another embodiment of the jumpsuit according to Embodiment 5 of the present disclosure.
Figure 9:
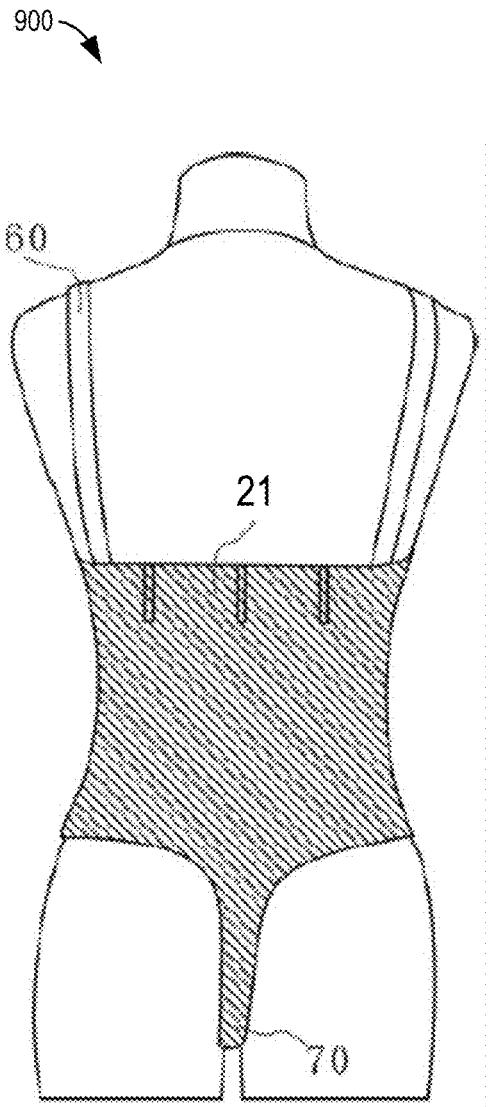
FIG. 9 is a back view of the jumpsuit of FIG. 8.

As shown in FIGS. 8-9, this embodiment provides a body-shaping garment 800, 900 with a jumpsuit structure, including a front panel set 10, a back piece set 21 and two shoulder straps 60. The front panel set 10 can extend from the bottom of the chest to the crotch and can be triangular in shape. The front panel set 10 and the back piece set 21 can be sewn together at the side seams. The front and rear ends of the two shoulder straps 60 can be respectively installed with 6-shaped buckles at the upper end of the front panel group 10 and the upper end of the back piece set 21.

For convenience of using the toilet, a back crotch piece 70 can be extended from the bottom end of the back piece set 21, and a hook set can be fixed at the end of the back crotch piece 70. The front piece set 10 can be fixedly provided with the crotch portion. The hook group can be matched with the buckle group. The hook group and the buckle group can cooperate to form a clasp. The clasp can serve as the second opening and closing member 12 for closing the crotch opening, so that the hook group and the buckle can be released when using the toilet. The connection of the ring set can open the crotch opening, improving convenience. In addition, antibacterial cotton can be sewn inside the back crotch piece 70, so that a wearer of this garment can optionally wear underwear.

In this embodiment, the front panel set 10 can be composed of multi-layer fabrics with patterns, including a top fabric layer 101, a lining fabric layer 102, and three fabric pieces positioned between the top fabric layer 101 and the lining fabric layer 102. The above-mentioned top fabric layer 101, three fabric pieces and the lining fabric layer 102 can be elastic fabrics, and the top fabric layer 101 has a see-through mesh structure with mesh, and the fabric pieces are breathable.

The spacing area left between two adjacent fabric pieces respectively can constitute a V-shaped curved hollow pattern 100. The V-shaped curved opening can face outwards and can have different widths at different positions along the V-shape curve. Specifically, the middle fabric piece can be distributed on the abdomen, the other two fabric pieces can be distributed on the left and right sides of the middle fabric piece. The middle fabric piece can form a V-shaped curved hollow pattern 100 with the left and right fabric pieces, respectively. The lining fabric layer 102 can be distributed on the three fabric pieces that correspond to the inside of the abdominal area. The top fabric layer 101 can cover the three fabric pieces. The edge of the fabric piece where the hollow pattern 100 is positioned and the lining fabric layer 102 can be sewn together with elastic threads or can be fixed with glue. The edges of the cut pieces, the edges of the lining fabric layer 102 and the edges of the top fabric layer 101 can be connected together through stitching, so that the three fabric cut pieces are distributed flatly on the outer surface of the lining fabric layer 102, and the middle part of the top fabric layer 101 is suspended between the intermediate fabric layer 103.

In this embodiment, the three fabric pieces of the top fabric layer 101 and the intermediate fabric layer 103 can be a black color, the lining fabric layer 102 can be a skin color, and the part of the top fabric layer 101 corresponding to the hollow pattern 100 can be a see-through mesh structure. The part of the lining fabric layer 102 corresponding to the hollow pattern 100 can be set as the background color part. The fabric pieces and the top fabric layer 101 can cooperate to cover the visual color of the lining fabric layer 102. The mesh size of the mesh part can be sufficient to be directly observed by the naked eye. On the lining fabric layer 102 corresponding to the hollow pattern 100, when worn, the naked eye can directly observe through the mesh portion a grid with the skin color of the base color portion as the base color and the V-shaped curved hollow pattern 100 as the outline pattern. In this embodiment, two V-shaped curved hollow patterns 100 formed by three fabric pieces can be symmetrically distributed on the front panel set 10, visually creating an S-shaped waist. In addition, a triangular hollow pattern 100 can be formed in the middle of the upper end of the front panel 10.

In order to facilitate putting on and taking off, the front panel set 10 of this embodiment can include a longitudinal opening and first opening and closing parts 11 positioned on both sides of the longitudinal opening. The upper end of the longitudinal opening can extend to the upper end of the shaping garment. The first opening and closing parts 11 can be a combination of zippers and buttons. The buttons can be positioned on the inside and the zipper can be positioned on the outside. The zipper and buttons can be used to open and close the longitudinal opening. In order to reduce the occurrence of curling at the upper ends of the front panel set 10 and the back piece set 21 when worn, a number of rubber ribs can be distributed at intervals along the upper ends of the back piece set 21.

In order to enhance the shaping effect of the abdomen, this embodiment also includes a non-elastic clip layer 104 in the multi-layer fabric corresponding to the abdominal area of the human body and positioned between the two hollow patterns 100. The non-elastic clip layer 104 can be positioned between the intermediate fabric layer 103 and the lining fabric layer 102. Between them and staggered from the hollow pattern 100, the non-elastic clip layer 104 can be composed of transversely inelastic fabric.

The basic principles, main features and advantages of the present disclosure have been shown and described above. Those skilled in the art should understand that the present disclosure is not limited by the above-mentioned embodiments. What is described in the above-mentioned embodiments is only to provide an understanding of the subject matter of the present disclosure, without departing from the creative spirit and scope of the present disclosure. However, it will be readily apparent to one of ordinary skill in the art that the present disclosure may be practiced without limitation to these specific details.

What is claimed is:

1. A multi-layer fabric, comprising:

a top fabric layer, a lining fabric layer and an intermediate fabric layer disposed between the top fabric layer and the lining fabric layer, with the intermediate fabric layer having a set of fabric pieces configured to form a certain hollow pattern between the set of fabric pieces, with a portion of the lining fabric layer that corresponds to the certain hollow pattern being a certain color, the top fabric layer having a see-through portion that corresponds to and overlays the portion of the lining fabric layer associated with the certain hollow pattern so that the certain color is viewable through the see-through portion of the top fabric layer.

2. The multi-layer fabric of claim 1, wherein the top fabric layer, the intermediate fabric layer and the lining fabric layer are stitched or seamlessly joined together.

3. The multi-layer fabric of claim 1, wherein the certain hollow pattern is configured as two opposing, discontinuous and symmetrical patterns.

4. The multi-layer fabric of claim 1, wherein each of the top fabric layer, the intermediate fabric layer and the lining fabric layer are composed of an elastic fabric.

5. The multi-layer fabric of claim 1, wherein the certain hollow pattern is configured as a continuous pattern.

6. The multi-layer fabric of claim 1, wherein the certain hollow pattern has varying widths defined between at least two of the set of fabric pieces of the intermediate fabric layer.

7. The multi-layer fabric of claim 1, wherein the see-through portion of the top fabric layer is composed of a see-through mesh material having a plurality of apertures.

8. The multi-layer fabric of claim 1, wherein a color of the top fabric layer is different from the color of the portion of the lining fabric layer as viewable through the see-through portion of the top fabric layer.

9. The multi-layer fabric of claim 1, wherein at least two of the set of fabric pieces of the intermediate fabric layer are separated, adjacent and planar, with the separation between the at least two fabric pieces defining the see-through portion of the top fabric layer.

10. A garment, comprising:

a multi-layer fabric that includes a top fabric layer, a lining fabric layer and an intermediate fabric layer disposed between the top fabric layer and the lining fabric layer, with the intermediate fabric layer having a set of fabric pieces configured to define a set of hollow patterns formed between the set of fabric pieces of the intermediate fabric layer, with a portion of the lining fabric layer that corresponds to each hollow pattern being a certain color, and the top fabric layer having a set of see-through portions with each see-through portion overlaying the portion of the lining fabric layer associated with the corresponding hollow pattern so that the certain color is viewable through the set of see-through portions of the top fabric layer.

11. The garment of claim 10, wherein the garment is a jumpsuit.

12. The garment of claim 10, wherein an upper front portion of the garment is configured to include a longitudinal opening having first opening and closing members positioned on both sides of the longitudinal opening, with an upper end of the longitudinal opening being extended towards an upper end of the garment.

13. The garment according to claim 10, wherein the set of hollow patterns is symmetrically arranged on a front portion of the garment.

14. The garment according to claim 10, wherein the multi-layer fabric is configured to correspond to an abdominal area of a wearer of the garment and is positioned between the set of hollow patterns.

15. The garment of claim 14, wherein an elastic-free layer is disposed between the intermediate fabric layer and the lining fabric layer.

16. The garment of claim 10, wherein each hollow pattern is shaped to conform to a curvature of a corresponding outside perimeter of the garment so that the curvature of the hollow pattern conforms to the curvature of the garment when worn.

17. The garment of claim 10, wherein each hollow pattern has varying widths between the corresponding fabric pieces of the intermediate fabric layer.

18. The garment of claim 10, wherein each see-through portion of the top fabric layer is composed of a see-through mesh material having a plurality of apertures.

19. The garment of claim 10, wherein a color of the top fabric layer is different from the color of the portion of the lining fabric layer as viewable through each see-through portion of the top fabric layer.

* * * * *